US010926269B2

(12) United States Patent
Radziszewski

(10) Patent No.: US 10,926,269 B2
(45) Date of Patent: Feb. 23, 2021

(54) VERTICAL GRINDING MILL, SCREW SHAFT, AND METHOD OF DESIGNING AND/OR MANUFACTURING A SCREW SHAFT

(71) Applicant: Metso Minerals Industries, Inc., Waukesha, WI (US)

(72) Inventor: Peter Henry Radziszewski, Baie D'Urfe (CA)

(73) Assignee: Metso Minerals Industries, Inc., Waukesha, WI (US)

( * ) Notice: Subject to any disclaimer, the term of this patent is extended or adjusted under 35 U.S.C. 154(b) by 285 days.

(21) Appl. No.: 15/829,297

(22) Filed: Dec. 1, 2017

(65) Prior Publication Data

US 2019/0168231 A1 Jun. 6, 2019

(51) Int. Cl.
*B02C 17/16* (2006.01)
*B02C 19/22* (2006.01)

(52) U.S. Cl.
CPC ..... *B02C 19/22* (2013.01); *B02C 17/163* (2013.01)

(58) Field of Classification Search
CPC ..... B02C 17/163; B02C 19/22
USPC ..... 241/260.1
See application file for complete search history.

(56) References Cited

U.S. PATENT DOCUMENTS 3,533,566 A 10/1970 Macquat
4,660,776 A 4/1987 Ikebuchi et al.
4,754,934 A 7/1988 Ikebuchi et al.
4,959,183 A 9/1990 Jameson
5,158,240 A 10/1992 Ihara et al.
5,346,146 A 9/1994 Nitta
8,205,817 B2 6/2012 Brook-Levinson et al.
2008/0138888 A1* 6/2008 Schmid ..... C12M 23/56 435/286.6
2010/0102151 A1 4/2010 Gerl et al.
2016/0144373 A1* 5/2016 Haas ..... B02C 17/163 241/172

FOREIGN PATENT DOCUMENTS

CN 106732971 A * 5/2017 ..... B02C 17/06
WO 2016079574 5/2016

OTHER PUBLICATIONS

International Search Report and Written Opinion for International Application No. PCT/US2018/062790 dated Feb. 6, 2019.

* cited by examiner

*Primary Examiner* — Shelley M Self
*Assistant Examiner* — Jared O Brown
(74) *Attorney, Agent, or Firm* — Andrus Intellectual Property Law, LLP

(57) ABSTRACT

A screw shaft for a vertically stirred grinding mill is arranged so as to be accommodated within a grinding chamber of the grinding mill while extending in a longitudinal direction. The screw shaft comprises a central shaft and at least one screw flight surrounding the central shaft, and the central shaft comprises an outer shaft wall defining a cavity within the interior of the central shaft, which cavity is closed at least at one longitudinal end of the central shaft.

16 Claims, 4 Drawing Sheets

VERTICAL GRINDING MILL, SCREW SHAFT, AND METHOD OF DESIGNING AND/OR MANUFACTURING A SCREW SHAFT

FIELD OF THE INVENTION

The present invention relates to vertical grinding mills or vertically stirred grinding mills, also called vertical auger mills, and to screw shafts for such vertical grinding mills. The invention also relates to a method of designing and/or manufacturing a screw shaft for a vertically stirred grinding mill.

A vertical grinding mill is available under the trade name "Vertimill" from Metso, for example.

BACKGROUND

Vertical grinding mills having a grinding chamber filled with grinding media and material to be ground, wherein a screw shaft inside the grinding chamber is rotated to stir the material, are known. Such a grinding mill is disclosed in WO 2016/079574 A1, for example. The grinding mill of FIGS. 1*a*, 1*b* and 2*a* of WO 2016/079574 A1 is shown in the enclosed FIGS. 1, 2 and 3, respectively.

In FIG. 1, the prior art grinding mill 1 comprises a screw shaft 2—also known as agitator, impeller or auger—in a grinding chamber 3. A slurry of water, the material to be ground, and optionally additives is fed into the chamber 3 via an opening 8 at the top of the chamber 3, and the screw shaft 2 is rotated, thereby agitating and imparting motion to the grinding media 4, which grinds the material to be ground within the chamber 3, as shown in FIG. 2. Hence, by a rotational movement of the screw 2, a grinding media motion is initiated, and the material—such as minerals and/or ore—is ground.

An external recycle pump 9 provides an uprising velocity flow within the chamber 3 which causes a classification of particles in the upper portion of the chamber 3. The grinded particles moving towards the upper portion of the chamber 3 are removed via an overflow launder 10. The small particles rise, while the large particles are drawn into the grinding media and ground further. The chamber 3 retains the grinding media and also supports drive components 5, such as a drive shaft 5*a*, thrust bearing 5*b*, gear reducer 5*c* and motor 5*d*. A door 7 for access into the chamber 3 is provided.

FIG. 3 shows the screw shaft 2, which has a central shaft 23 and a number of screw flights 24.

In many vertically stirred grinding mills, the screw shaft hangs from a thrust bearing assembly, such as the thrust bearing 5*b* in the grinding mill of FIGS. 1 to 3. The bearing supports the entire screw shaft, so that bearing pressures can become quite high.

Due to the bearing pressures, a bearing resistance is exerted, and energy is lost due to friction at the bearing. This reduces the equipment efficiency and equipment lifetime.

Hence, a problem which is frequently encountered with vertically stirred grinding mills is a reduced lifetime of a thrust bearing.

SUMMARY

An object of the present invention is to provide a screw shaft for a vertical grinding mill which is designed so as to provide for a prolonged lifetime of a thrust bearing supporting the screw shaft.

In view of the above, the present invention provides a screw shaft for a vertically stirred grinding mill of claim 1, a vertically stirred grinding mill of claim 10 and a method of designing and/or manufacturing a screw shaft as recited in claim 12.

The present invention is based on the idea that a buoyancy force acts on the screw shaft when immersed in the slurry and the grinding media.

The buoyance force acts according to Archimedes' principle, which states that the upward buoyant force that is exerted on a body immersed in a fluid, whether fully or partially submerged, is equal to the weight of the fluid that the body displaces and acts in the upward direction at the center of mass of the displaced fluid. Buoyancy reduces the apparent weight of objects which are partly or completely immersed. The weight of the object in the fluid is reduced because of the force acting on it, which is called upthrust.

The gravity force resulting from the screw shaft depends on the weight of the screw shaft. The downward gravity force counter-acts the upward buoyant force.

In a vertically stirred grinding mill, further forces act upon the screw shaft, including a downward gravity force resulting from the weight of the grinding media (primarily acting on the screw flight(s)), and a downward axial force resulting from rotation of the screw shaft.

The idea is, on the one hand, to reduce the weight of the screw shaft and to thereby reduce the gravity force acting on the screw shaft. On the other hand, the screw shaft is designed so that a buoyancy force acts upon the screw shaft which is sufficiently large to counteract the gravity force, as well as other forces acting in the direction of gravity, to a certain or predetermined extent. This is achieved by configuring the central shaft so as to comprise an outer shaft wall defining a cavity within the interior of the central shaft, which cavity is closed at least at one longitudinal end of the central shaft, i.e. in other words by making the central shaft of the screw shaft at least partially hollow. Hence, the mass of the screw shaft is reduced at constant volume, so that the density of the screw shaft is reduced and the weight thereof can be more easily compensated by the buoyancy force. Consequently, the total force acting on the bearing is reduced, and bearing resistance and friction are reduced.

The central shaft is at least partially hollow. Hollow in particular means that the central shaft is not solid. The hollow shaft does not need to be entirely hollow. The hollow shaft is not solid or massive in its entirety. In particular, the shaft does not entirely consist of steel. The interior of the central shaft may be basically free from steel.

However, the hollow shaft does not need to be empty, i.e. the cavity or internal space may be filled, in particular with material that is lighter (less dense) than the material of the central shaft, which is e.g. steel. Hence, the cavity in the central shaft may be filled with material having a lower density than the material of the central shaft.

The cavity in the central shaft is in particular closed against the outside. In particular, the hollow shaft is closed or sealed against the surrounding slurry when accommodated in the grinding chamber. Put differently, the hollow shaft is closed against slurry accommodated within the grinding chamber.

The hollow shaft does not receive slurry in its interior. The central shaft may be free from a slurry supply or a cooling water supply.

Preferably, the central shaft has the shape of a cylinder which is at least partially hollow and closed at one end so as to define said cavity (in contrast to a solid cylinder). The wall thickness of the hollow cylinder may be between 0.1 and 0.5 m, depending on the diameter of the cylindrical shaft, for example.

Additionally, the following is noted: Objects with greater volume have greater buoyancy. Therefore, the greater the volume of the central shaft of the presently claimed screw shaft (wherein a greater volume of the central shaft can particularly be achieved by the central shaft having a greater diameter), the greater the buoyancy force acting on the screw shaft. The increased buoyancy force counter-acts the weight of the central shaft and the attached screw flight(s), so that the bearing load and bearing pressure and consequently bearing resistance and friction are reduced.

If the diameter of the central shaft is sufficiently large for the buoyancy force acting on the screw shaft during use (which equals the weight of the fluid that the system displaces) to even be substantially equal to the weight of the screw shaft, bearing friction can suitably be reduced.

Preferably, the diameter of the screw shaft is at least 2.0, 2.5, 3.0, 4.0, 4.5, 5.0, 5.5, or 6.0 m.

The screw shaft can be structured such that a buoyancy force acting on the screw shaft does not over-compensate for the weight thereof, i.e. that the buoyancy force is not higher than the gravity force. In that case, the buoyance force does not compensate for more than 100% of the weight.

However, as explained above, further forces in addition to the gravity force resulting from the weight of the screw shaft act in the direction of gravity, including a force created by the weight of the grinding media (e.g. grinding balls) which are in contact with the screw flights, and a force along the central axis of the screw shaft which is created upon rotation of the screw shaft carrying the helical flights. As a consequence, the screw shaft—specifically the diameter thereof—could even be designed so that the buoyancy force compensates not only the weight of the screw shaft, but at least partially compensates these other forces acting in the direction of gravity, too.

If the diameter of the central shaft is very large and the interior cavity is very large, it might happen that the buoyancy force exceeds the total downward forces acting on the screw shaft. This implies that the gravity force acting on the screw shaft is low, in case of a lightweight central shaft, such as a hollow and thin-walled central shaft. To avoid a situation in which the thrust bearing has to take up the resulting upward force, mass should be added to the central shaft, so as to increase the gravity force. For example, additional weight could be filled into the interior of the central shaft as ballast.

Grinding media, in particular grinding balls, are preferably made out of steel or ceramics or stone. The ball size can e.g. be about 10 mm. Any known grinding media or grinding aids can be used in a grinding mill together with the screw shaft of the present invention.

The material to be ground will mostly comprise minerals and/or ore. In the slurry, the material to be ground, water and optionally additives are present. The slurry and the grinding media are received in the grinding chamber and the combination of slurry and the grinding media is stirred by the screw shaft. The slurry and the grinding media form a fluid and, therefore, exert a buoyancy force onto the screw shaft when immersed into the slurry and grinding media, i.e. during use.

Usually, the combination of the slurry and the grinding media in the grinding chamber has an average specific density between 4 and 7, preferably between 5 and 6, more preferably between 5.0 and 5.5. (The specific density is the ratio of the density of the combination of the slurry and the grinding media to the density of water at 4° C.) The buoyance force created depends on this specific gravity/density.

Summing up, depending on the diameter (or more generally the volume) of the central shaft and the mass of the screw shaft, a buoyancy force can be obtained which is almost equal to the weight of the screw shaft or even larger than that. This leads to reduction of energy losses at the bearing, since the weight of the shaft is at least partially or basically compensated and in some embodiments further forces acting in the direction of gravity are at least partially compensated, too.

The vertically stirred grinding mill of the invention can be used as a primary, re-grinding or lime slaking mill. The vertically stirred grinding mill is gravity-induced. The vertical grinding mill is configured for a wet grinding process.

The vertically stirred grinding mill or vertical grinding mill provides for efficient size reduction mechanism of the material to be ground. For example, the feed size of the material to be ground may be 6 mm and, finally, a size of less than 20 mm can be achieved for the ground material.

The screw shaft comprises the central shaft and at least one screw flight attached to the shaft so as to form an agitating screw. The agitating screw may be suspended into a grinding chamber, supported by spherical roller bearings and driven by a fixed speed motor through a planetary gear box. The screw rotates around a vertical axis.

Typically, the mill is arranged in a closed circuit and fed by the cyclone underflow. However, it is also conceivable that a reversed close circuit is applied. It is also conceivable to use a top feed with or without recycle system. A bottom feed with or without recycle system is conceivable.

The screw is driven, preferably at a constant speed, to stir the grinding media and the minerals and/or ore. As the particles are ground, they rise to the top of the mill. By means of a change in the rotational direction and overflow in a separating tank, the ground material is obtained.

The dependent claims define further optional features of the invention.

Preferably, an outer diameter $D_{shaft}$ of the central shaft and a mass of the screw shaft are set such that, in a state in which the grinding chamber is filled with a slurry comprising material to be ground and with grinding media, and the screw shaft is at least partially immersed therein, a buoyancy force acting on the screw shaft compensates for at least 20, 30, 40, 50, 60, 70, 80, 90, or 100% of the weight thereof.

The method of designing and/or manufacturing of the present invention can include a corresponding step of setting an outer diameter $D_{shaft}$ of the central shaft and a mass of the screw shaft such that, in a state in which the grinding chamber is filled with a slurry comprising the material to be ground and with the grinding media, and the screw shaft is at least partially immersed therein, a buoyancy force acting on the screw shaft compensates for a predetermined part of the weight thereof and/or a predetermined part of the total forces acting on the screw shaft in the direction of gravity.

The screw shaft is preferably closed at the bottom so as to provide a proper surface for the buoyancy force to act upon.

The ratio between the volume the screw shaft displaces when immersed into the grinding chamber filled with slurry and grinding media and the mass of the screw shaft corresponds to the mean density of the screw shaft. The mean specific gravity of the screw shaft may be less than 5, preferably less than 4.5, 4.0, 3.5, 3.0, 2.5, 2.0, or 1.5.

The vertically stirred grinding mill may comprise a thrust bearing, wherein the screw shaft hangs from the thrust bearing. The screw shaft may comprise drive components, in particular a drive shaft, a thrust bearing, a gear reducer and a motor.

Specifically, the screw shaft of the present invention can be configured so as to reduce the amount of grinding media to be handled, by at least about 30, 40 or 50%. This is accomplished by reducing the size of the screw flight or the ratio of the diameter of the screw flight and the diameter of the central shaft, respectively. Conventionally, the ratio $D_{shaft}/D_{screw}$ (see FIG. 3) can be as low as about 0.05. According to the invention, the diameter of the central shaft may be increased relative to a conventional, small diameter central shaft. In many cases this will entail an increase of the ratio $D_{shaft}/D_{screw}$ to values above 0.3. In certain cases, in which emphasis is put on the buoyancy effect while a small screw flight is sufficient, the ratio could even approach the value of 1. The relationship $D_{shaft}/D_{screw} \geq 0.4$, 0.5, 0.6, 0.7, 0.8 or 0.9 is preferably fulfilled.

Reducing the amount of grinding media in the mill does not necessarily result in a declined performance. In conventional vertically stirred grinding mills, about half of the media is not involved in the grinding process anyhow. Media not involved in the breakage moves between the helices and moves with the auger. Put differently, media between the helices does very little work, and grinding primarily takes places at the outer end of the screw, wherein the material in the inner part of the screw is mainly stirred without grinding efficiency. This is also reflected in that there is a lack of wear on the auger shaft and the helices underside and a very small amount of wear on the helices' top side.

The highest amount of work accomplished occurs between the helices' circumferential edge and the mill shell. This is evidenced by the high wear rate at the edges of the helices.

By broadening the central shaft as compared to the screw flight, the amount of media in that region is reduced. The media charge level is maintained, while "non-working" media between the helices is removed.

Hence, the energy, i.e. the output energy per grinding media mass (in particular per ball mass) as a function of the single collision energy is reduced by means of the increased diameter of the auger. Thus, reducing the media in a vertical grinding mill by reducing the amount of media that is basically not ground is achieved.

BRIEF DESCRIPTION OF THE DRAWINGS

The above, as well as additional objects, features and advantages of the present invention will be better understood through the following illustrative and non-limiting detailed description of preferred embodiments of the present invention with reference to the appended drawing FIG. 4, where the same reference numerals will be used for similar elements. In the drawings.

DETAILED DESCRIPTION

Figure 1:
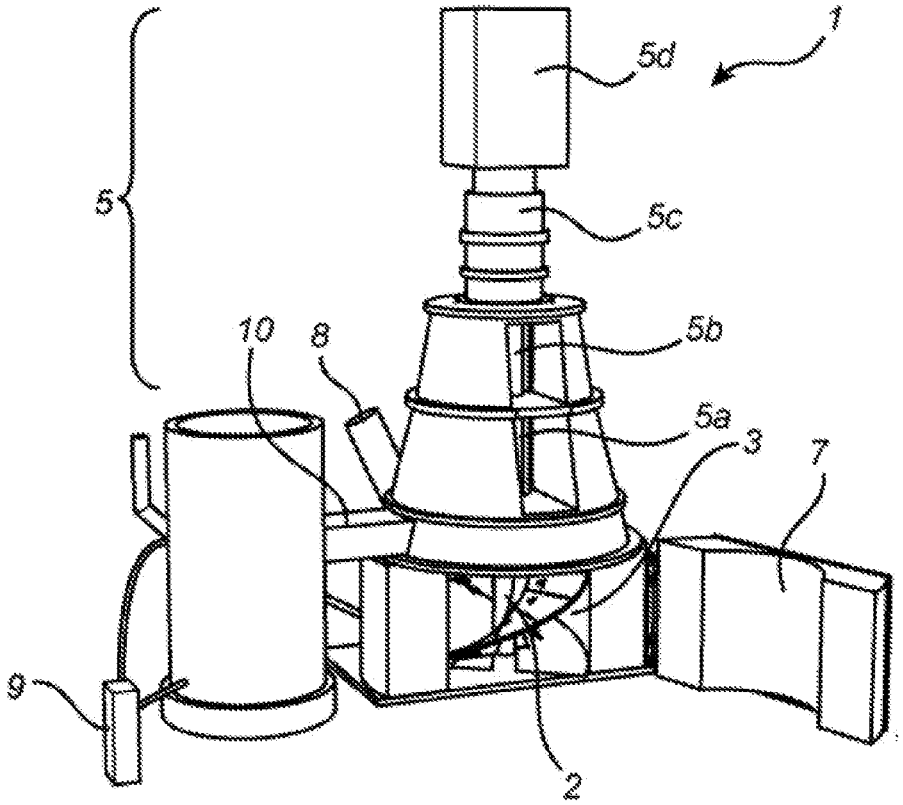
Prior art Figure 1
FIG. 1 shows a vertical grinding mill according to the prior art.
Figure 2:
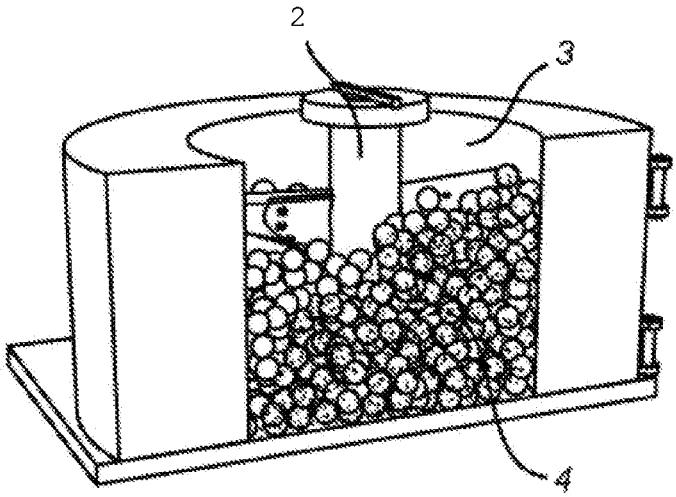
Prior art Figure 2
FIG. 2 shows a grinding chamber according to the prior art.
Figure 3:
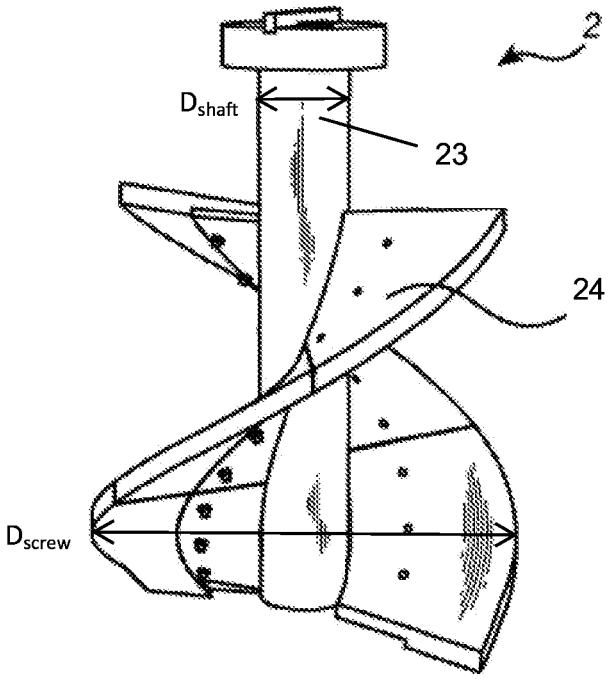
Prior art Figure 3
FIG. 3 shows a screw shaft for a vertically stirred grinding mill according to the prior art.
Figure 4:
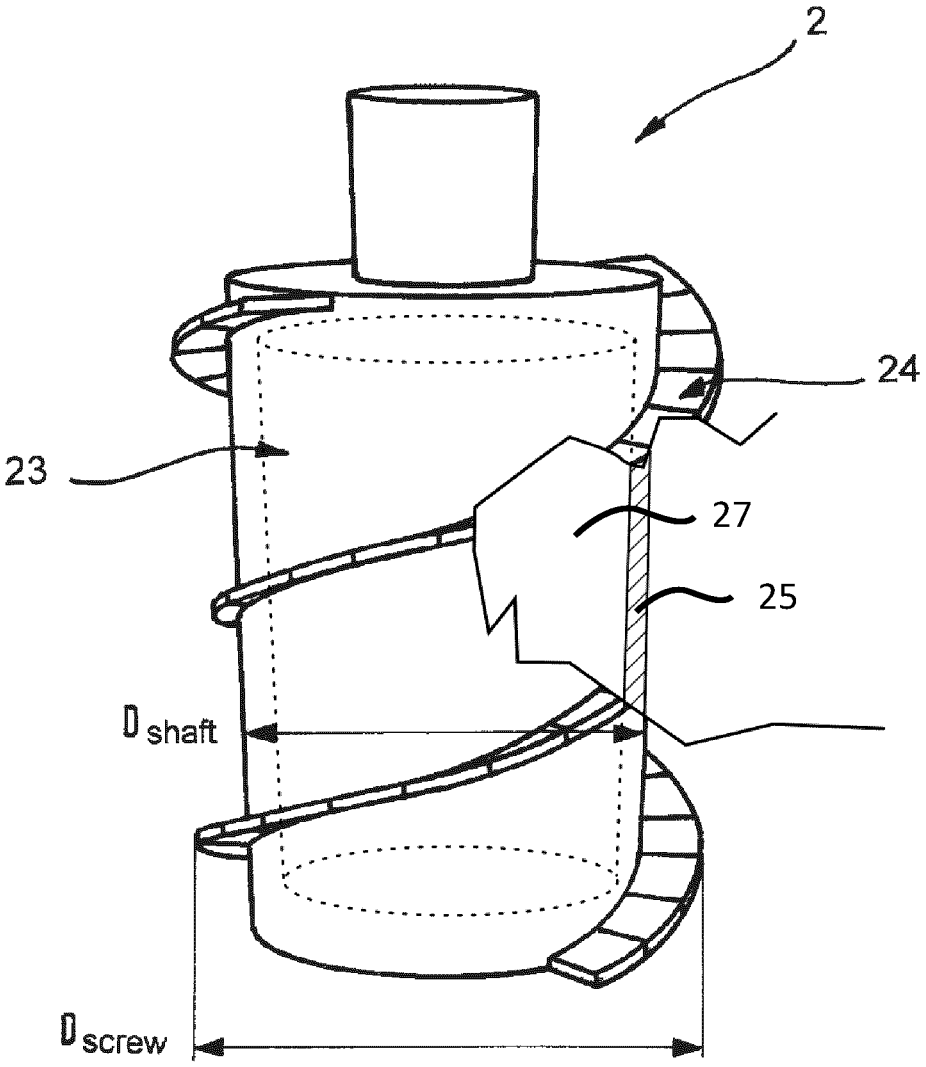
FIG. 4 shows a screw shaft for a vertically stirred grinding mill according to the present invention.

As explained above, FIGS. 1 to 3 show a prior art vertical grinding mill. The vertical grinding mill according to the present invention differs as follows from this prior art:

FIG. 4 depicts an impeller (auger) or screw shaft 2 according to the present invention, comprising a central shaft 23 and a number of screw flights 24 surrounding the central shaft 23. The screw shaft is accommodated within a grinding chamber of a vertical grinding mill so as to extend in a longitudinal direction. The longitudinal direction of the screw shaft coincides with the vertical direction in the state in which the screw shaft 2 is mounted in the vertical mill. As shown in the partial section of FIG. 4, the central shaft 23 comprises an outer shaft wall 25 defining a cavity 27 within the interior of the central shaft. The cavity 27 is closed at least at one longitudinal end of the central shaft. As a consequence, the central shaft 23 has the shape of a hollow cylinder which is closed at one end, which is the bottom end in the state in which the screw shaft 2 is mounted in the vertical mill. The wall thickness of the outer wall 25 of the central shaft 23 is about 0.1 m.

In this embodiment, additionally, the diameter of the central shaft 23 is enlarged as compared to screw shafts of the prior art. Preferably, the diameter of the screw shaft 2 is constant, i.e. not changed along the axis of rotation. The diameter of the screw shaft, i.e. the outer diameter of the flights 24, is not necessarily different from conventional screw shafts. Hence, in a preferred embodiment, only the central shaft 23 relative to the flights 24 of the screw shaft 2 is modified.

The screw shaft comprises means for being supported by way of a thrust bearing, said means being arranged at a vertically upper section of the screw shaft 2. The vertically stirred grinding mill comprises a thrust bearing, wherein the screw shaft 2 hangs from the thrust bearing.

The outer diameter $D_{shaft}$ of the central shaft 23 and a mass of the screw shaft 2 are set such that, in a state in which the grinding chamber is filled with a slurry comprising material to be ground and with grinding media, and the screw shaft 2 is at least partially immersed therein, a buoyancy force acting on the screw shaft 2 compensates for a predetermined share of the weight thereof, e.g. at least half of the weight thereof.

Hence, the force acting on the thrust bearing is reduced, since the only half of the weight of the screw shaft acts on the bearing.

As indicated in FIG. 4, the diameter of the central shaft may be larger than in the case of conventional shafts. The diameter of the central shaft $D_{shaft}$ relative to the diameter of the screw $D_{screw}$ preferably at least fulfills the relationship: $D_{shaft}/D_{screw} \geq 0.3$, 0.4, 0.5, preferably 0.6, more preferably 0.7, most preferably 0.8 or 0.9. $D_{shaft}/D_{screw}$ is smaller than 1.

Preferably, the outer diameter $D_{shaft}$ of the central shaft 23 and the mass of the screw shaft 2 are set such that the buoyancy force acting on the screw shaft 2 during use is substantially equal to the weight thereof, preferably the buoyance force compensates for 80 to 95% of the weight, more preferably 90 to 95%.

The central shaft 23 of the screw shaft 2 may at least partially be hollow and closed at the bottom so as to provide a surface for the buoyancy force to act upon. Put differently, the central shaft is closed or sealed against the outside, so as to avoid that slurry and/or grinding media gets into the central shaft.

For example, if $D_{shaft}$ equals 3 m and the wall thickness is 0.1 m, the buoyancy force is approximately 730 kN, wherein the weight of the shaft is about 666 kN, which is about 75 tons. The buoyancy force exceeds the weight of the shaft and can also counter-act the other downward forces, such as the axial force created upon rotation of the screw shaft.

In a preferred embodiment, the diameter of the central shaft $D_{shaft}$ is increased from 0.7 m (conventional shaft thickness) to about 4.0 m, wherein the (constant) diameter of the screw is about 4.8 m. The reduction in volume of the grinding media in the grinding chamber is, for this case, about 50%. Thus, the amount of media between the helices is also reduced by increasing the shaft diameter.

In another example, a conventional screw shaft would have a screw flight diameter of 8 inches and a central shaft diameter of 2 inches, whereas a screw shaft according to the present invention has the same screw flight of 8 inches on a central shaft having a 6 inches diameter. This leaves a 1 inch wide helix on either side of the central shaft.

In the embodiment of FIG. 4, the central shaft 23 is substantially hollow, so that the weight thereof is low, while a high buoyancy force acts on the screw shaft 2 due to its large diameter when the screw shaft is installed in the vertical grinding mill and the slurry and grinding media are filled in. It might be necessary to fill the hollow shaft with ballast, so as to prevent the buoyancy force from excessively exceeding the gravity force.

The screw shaft 2 may be designed as follows:

Choosing a type of material to be ground by means of the grinding mill, and choosing the type of grinding media to be used, designing and/or providing a screw shaft 2 to be accommodated within a grinding chamber of the grinding mill, the screw shaft 2 comprising a central shaft 23 and at least one screw flight 24 surrounding the central shaft 23, wherein the central shaft comprises an outer shaft wall defining a cavity within the interior of the central shaft, which cavity is closed at least at one longitudinal end of the central shaft, and preferably, setting an outer diameter $D_{shaft}$ of the central shaft 23 and a mass of the screw shaft 2 such that, in a state in which the grinding chamber is filled with a slurry comprising the material to be ground and with the grinding media, and the screw shaft 2 is at least partially immersed therein, a buoyancy force acting on the screw shaft 2 compensates for compensates for a predetermined part of the weight thereof and/or a predetermined part of the total forces acting on the screw shaft in the direction of gravity.

According to the method, the screw shaft and the vertically stirred grinding mill can be manufactured. For example, the following settings could additionally be implemented:

the buoyance force compensates for 80 to 95% of the weight, more preferably 90 to 95%, the outer diameter $D_{shaft}$ of the central shaft 23 and an outer diameter $D_{screw}$ of the screw flight (24) fulfil the relationship:

$$0.3 \leq D_{shaft}/D_{screw} < 1,$$

the density of the screw shaft is less than . . . kg/m$^3$.

The screw shaft of the invention can include one screw flight or helix or several helices. In a preferred variant, the screw shaft of the invention includes four helices, equally distributed about the diameter of the central shaft.

The Following Items Also Relate to the Invention

Item 1: A screw shaft (2) for a vertically stirred grinding mill, wherein the screw shaft (2) is arranged so as to be accommodated within a grinding chamber of the grinding mill while extending in a longitudinal direction, the screw shaft (2) comprising a central shaft (23) and at least one screw flight (24) surrounding the central shaft (23), and the central shaft (23) comprising an outer shaft wall (25) defining a cavity (27) within the interior of the central shaft (23), which cavity is closed at least at one longitudinal end of the central shaft (23).

Item 2: The screw shaft (2) of item 1, wherein the central shaft (23) has the shape of a cylinder which is at least partially hollow and closed at one end so as to define said cavity.

Item 3: The screw shaft (2) of item 1 or 2, wherein said cavity is at least partially filled with a material which has a density smaller than that of the material of the central shaft (23).

Item 4: The screw shaft of any one of the preceding items, wherein an outer diameter ($D_{shaft}$) of the central shaft (23) and a mass of the screw shaft (2) are set such that, in a state in which the grinding chamber is filled with a slurry comprising material to be ground and with grinding media, and the screw shaft (2) is at least partially immersed therein, a buoyancy force acting on the screw shaft (2) compensates for at least half of the weight thereof, preferably 60, 70, 80, 90, or 100% of the weight thereof.

Item 5: The screw shaft of any one of the preceding items, wherein the outer diameter ($D_{shaft}$) of the central shaft (23) and the mass of the screw shaft (2) are set such that the buoyancy force acting on the screw shaft (2) during use is substantially equal to the weight thereof, preferably the buoyance force compensates for 80 to 95% of the weight, more preferably 90 to 95%.

Item 6: The screw shaft (2) of any one of items 1 to 5, further comprising means for being supported by way of a thrust bearing arranged at a vertically upper section of the screw shaft.

Item 7: The screw shaft of any one of the preceding items, wherein the outer diameter ($D_{shaft}$) of the central shaft (23) and an outer diameter ($D_{screw}$) of the screw flight (24) fulfil the following relationship:

$$0.3 \leq D_{shaft}/D_{screw} < 1.$$

Item 8: The screw shaft (2) of item 7, wherein the relationship $D_{shaft}/D_{screw}$ 0.4, 0.5, 0.6, 0.7, 0.8 or 0.9 is fulfilled.

Item 9: The screw shaft (2) of any of the preceding items, wherein the specific gravity of the screw shaft, i.e. the ratio of the mass of the screw shaft and the volume thereof relative to the density of water, is less than 7, preferably less than 6, more preferably less than 5.5.

Item 10: A vertically stirred grinding mill for grinding minerals and/or ore, the mill comprising a screw shaft (2) of any of the preceding items and a grinding chamber in which the screw shaft (2) is accommodated.

Item 11: The vertically stirred grinding mill of item 10, further comprising a thrust bearing, wherein the screw shaft (2) hangs from the thrust bearing.

Item 12: A method of designing and/or manufacturing a screw shaft (2) for a vertically stirred grinding mill, comprising the steps of:

choosing a type of material to be ground by means of the grinding mill, and choosing the type of grinding media to be used, and designing and/or providing a screw shaft (2) to be accommodated within a grinding chamber of the grinding mill, the screw shaft (2) comprising a central shaft (23) and at least one screw flight (24) surrounding the central shaft (23), wherein the central shaft (23) comprises an outer shaft wall defining a cavity within the interior of the central shaft (23), which cavity is closed at least at one longitudinal end of the central shaft (23).

Item 13: The method of designing and/or manufacturing a screw shaft (2) for a vertically stirred grinding mill according to item 12, comprising the further the step of:

setting an outer diameter ($D_{shaft}$) of the central shaft (23) and a mass of the screw shaft (2) such that, in a state in which the grinding chamber is filled with a slurry comprising the material to be ground and with the grinding media, and the screw shaft (2) is at least partially immersed therein, a buoyancy force acting on the screw shaft (2) compensates for a predetermined part of the weight thereof and/or a predetermined part of the total forces acting on the screw shaft (2) in the direction of gravity.

I claim:

1. A screw shaft for a vertically stirred grinding mill, wherein the screw shaft is arranged so as to be accommodated within a grinding chamber of the grinding mill while extending in a longitudinal vertical direction, the screw shaft comprising:

a central shaft and at least one screw flight surrounding the central shaft; and the central shaft comprising an outer shaft wall defining a cavity within an interior of the central shaft, and the cavity is closed at least at one longitudinal end of the central shaft, wherein an outer diameter (Dshaft) of the central shaft and a mass of the screw shaft are set such that a buoyancy force acting on the screw shaft during use compensates for at least half of the weight thereof.

2. The screw shaft of claim 1, wherein the central shaft has the shape of a cylinder which is at least partially hollow and closed at one end so as to define said cavity.

3. The screw shaft of claim 1, wherein said cavity is at least partially filled with a material which has a density smaller than that of the material of the central shaft.

4. The screw shaft of claim 1, wherein the buoyancy force compensates for between 60 to 100% of the weight of the screw shaft.

5. The screw shaft of claim 1, further comprising a thrust bearing arranged at a vertically upper section of the screw shaft.

6. The screw shaft of claim 1, wherein the specific gravity of the screw shaft is less than 7.

7. The screw shaft of claim 1, wherein the specific gravity of the screw shaft is less than 6.

8. The screw shaft of claim 1, wherein the specific gravity of the screw shaft is less than 5.5.

9. The screw shaft of claim 1, wherein the outer diameter (Dshaft) of the central shaft and the mass of the screw shaft are set such that a buoyancy force acting on the screw shaft during use is substantially equal to the weight thereof.

10. The screw shaft of claim 9, wherein the buoyancy force compensates for 80 to 95% of the weight of the screw shaft.

11. The screw shaft of claim 10, wherein the buoyancy force compensates for 90 to 95% of the weight of the screw shaft.

12. The screw shaft of claim 1, wherein the outer diameter (Dshaft) of the central shaft and an outer diameter (Dscrew) of the screw flight fulfil the following relationship:

$$0.3 \leq Dshaft/Dscrew < 1.$$

13. The screw shaft of claim 12, wherein the relationship Dshaft/Dscrew≥0.4, 0.5, 0.6, 0.7, 0.8 or 0.9 is fulfilled.

14. A vertically stirred grinding mill for grinding minerals and/or ore, the mill comprising a screw shaft of claim 1 and a grinding chamber in which the screw shaft is accommodated.

15. The vertically stirred grinding mill of claim 14, further comprising a thrust bearing, wherein the screw shaft hangs from the thrust bearing.

16. A method of designing and/or manufacturing a screw shaft for a vertically stirred grinding mill including a grinding chamber, comprising the steps of:

choosing a type of material to be ground by the grinding mill, and choosing the type of grinding media to be used;

designing and/or providing the screw shaft to be accommodated within the grinding chamber of the grinding mill, the screw shaft comprising a central shaft and at least one screw flight surrounding the central shaft; and setting an outer diameter (Dshaft) of the central shaft and a mass of the screw shaft such that, in a state in which the grinding chamber is filled with a slurry comprising the material to be ground and with the grinding media, and the screw shaft is at least partially immersed therein, a buoyancy force acting on the screw shaft compensates for at least half of the weight thereof, wherein the central shaft comprises an outer shaft wall defining a cavity within an interior of the central shaft, and the cavity is closed at least at one longitudinal end of the central shaft.

* * * * *